US008590075B1

(12) United States Patent
Amjad et al.

(10) Patent No.: US 8,590,075 B1
(45) Date of Patent: Nov. 26, 2013

(54) MATTRESS ASSEMBLY FOR NEWBORN INFANTS

(76) Inventors: Ibrahim H. Amjad, Miami, FL (US); Norman Raul Shimizu, Pembroke Pines, FL (US)

( * ) Notice: Subject to any disclaimer, the term of this patent is extended or adjusted under 35 U.S.C. 154(b) by 153 days.

(21) Appl. No.: 12/802,590

(22) Filed: Jun. 9, 2010

Related U.S. Application Data

(60) Provisional application No. 61/268,112, filed on Jun. 9, 2009.

(51) Int. Cl.
*A47C 16/00* (2006.01)

(52) U.S. Cl.
USPC ..... 5/603; 5/655; 5/655.4; 5/655.5

(58) Field of Classification Search
USPC ..... 5/603, 644, 645, 702, 727–729, 739, 5/654, 655.4, 655.5, 909, 911; 297/452.41, 452.48
See application file for complete search history.

(56) References Cited

U.S. PATENT DOCUMENTS

| | | | | |
|---|---|---|---|---|
| 3,047,888 | A | 8/1962 | Shecter et al. | |
| 3,689,948 | A | 9/1972 | Graves et al. | |
| 3,721,232 | A | 3/1973 | Trenchard | |
| 3,729,752 | A | 5/1973 | Huggins | |
| 3,789,442 | A | 2/1974 | Tobinick | |
| 3,810,265 | A | 5/1974 | McGrew | |
| 3,846,857 | A | 11/1974 | Weinstock | |
| 3,858,379 | A | 1/1975 | Graves et al. | |
| 3,968,530 | A | 7/1976 | Dyson | |
| 4,027,888 | A * | 6/1977 | Wilcox | 297/452.17 |
| 4,139,920 | A | 2/1979 | Evans | |
| 4,163,297 | A | 8/1979 | Neumark | |
| 4,281,425 | A | 8/1981 | Jacobs | |
| 4,519,107 | A * | 5/1985 | Dillon et al. | 5/261 |
| 4,607,403 | A | 8/1986 | Alivizatos | |
| 4,689,844 | A | 9/1987 | Alivizatos | |
| 4,699,424 | A | 10/1987 | Andres et al. | |
| 4,788,730 | A * | 12/1988 | Bexton | 5/676 |
| 4,825,487 | A | 5/1989 | Eberl | |
| 5,127,120 | A | 7/1992 | Mason | |
| 5,201,780 | A | 4/1993 | Dinsmoor, III et al. | |
| 5,362,543 | A | 11/1994 | Nickerson | |
| 5,387,177 | A | 2/1995 | Dunn | |
| 5,475,882 | A | 12/1995 | Sereboff | |
| 5,511,260 | A | 4/1996 | Dinsmoor, III et al. | |
| 5,549,743 | A | 8/1996 | Pearce | |
| 5,566,413 | A | 10/1996 | Webb et al. | |
| 5,636,395 | A | 6/1997 | Serda | |
| 5,680,662 | A | 10/1997 | Purdy et al. | |
| 5,737,788 | A | 4/1998 | Castellino et al. | |

(Continued)

*Primary Examiner* — Nicholas Polito
(74) *Attorney, Agent, or Firm* — Malloy & Malloy, P.L.

(57) ABSTRACT

A mattress assembly structured for comfortable support of an infant, such as a prematurely born or newborn infant. The mattress assembly includes a base and a compressible material border disposed on the base in at least partially retaining and surrounding relation to a cushioning assembly. The cushioning assembly comprises a plurality of compartments containing a viscous material, such as silicone, collectively underlying and disposed in alignment with the placement area. A smoothing section is disposed and structured to prevent excessive sinking of the infant into the plurality of compartments. Damage to the infant's skin is prevented or reduced by the provision of a particulate section comprising a casing at least partially filled with a plurality of silicone microbeads, and a contact section formed of shear resistant material collectively defining outer portions of the mattress assembly and extending throughout the placement area on which the infant is intended to be disposed.

23 Claims, 4 Drawing Sheets

(56) References Cited

U.S. PATENT DOCUMENTS

| | | | | |
|---|---|---|---|---|
| 5,966,763 | A * | 10/1999 | Thomas et al. | 5/715 |
| 6,026,527 | A | 2/2000 | Pearce | |
| 6,052,851 | A | 4/2000 | Kohnle | |
| 6,145,143 | A | 11/2000 | Hicks et al. | |
| 6,197,099 | B1 | 3/2001 | Pearce | |
| 6,230,351 | B1 | 5/2001 | Kohnle | |
| 6,263,526 | B1 | 7/2001 | Tu | |
| 6,393,640 | B1 * | 5/2002 | Dalis | 5/497 |
| 6,421,859 | B1 | 7/2002 | Hicks et al. | |
| 6,546,579 | B1 | 4/2003 | Leventhal et al. | |
| 6,679,830 | B2 | 1/2004 | Kolarovic et al. | |
| 6,739,008 | B1 | 5/2004 | Kindrick | |
| 6,901,617 | B2 | 6/2005 | Sprouse, II et al. | |
| 8,117,700 | B2 * | 2/2012 | Howard | 5/690 |

* cited by examiner

MATTRESS ASSEMBLY FOR NEWBORN INFANTS

CLAIM OF PRIORITY

The present application is a non-provisional application claiming the benefit of U.S. provisional application having Ser. No. 61/268,112 filed on Jun. 9, 2009, the contents of which are incorporated by reference herein in its entirety.

BACKGROUND OF THE INVENTION

1. Field of the Invention

This invention is directed to a mattress assembly adapted for use in an infant care facility and is structured especially, but not exclusively, for a newborn and/or pre-mature infant. The mattress assembly includes a plurality of mattress components disposed in predetermined, interactive relation to one another so as to define a placement area on which the infant may be disposed for support and care. The mattress components are cooperatively structured and collectively disposed to eliminate or at least significantly reduce discomfort to the infant and the possibility of abrasion or other damage to the infant's skin when disposed on the placement area.

2. Description of the Related Art

In many hospitals and other similarly functioning facilities, it is common practice to utilize mattresses or similar types of support structures which function to distribute the pressure exerted thereon by a patient, evenly and/or in a predetermined pattern over portions of the patient's body. The function of such mattress structures is to provide adequate support and comfort to a patient, while in a prone position, and to eliminate or significantly reduce the occurrence of bed sores which are also known as "decubitus ulcers." Conventional attempts to provide such support while eliminating abrasions, damage or discomfort to the individual, include mattresses and like support structures which are inflated with a gas, or alternatively, at least partially filled with water or other liquid(s) or liquid type composition(s). It is believed that such gas inflated or liquid filled mattress structures serve to distribute the pressure in an equal and/or more effective manner over various portions of the individual's body than that accomplished by more conventional spring-type mattresses, even when significant padding for cushioning is provided.

When dealing with newborn infants, and in particular premature infants, extreme measures must be taken to eliminate or significantly reduce the possibility of pain, discomfort, harm or damage to the infant's body. Furthermore, it is well recognized that the skin, as well as other portions of an infant's body are extremely tender and fragile, and therefore, unusually sensitive to any touch or other outside influences. Proper care and treatment is even more important when dealing with severely premature infants depending at least in part on the actual period of gestation before birth.

More specifically, premature and other newborn infants are frequently required to stay for an extended period within an intensive care environment of a hospital that is often referred to as a "neo-natal" or like care unit of a medical facility. During such periods of care and treatment, the infant is subjected to incubators, warming appliances, other medical equipment and/or treatment, which control and regulate ambient conditions of the infant's environment. Even in situations where the infant is carried to full term, care must be used to maintain the infant in a secure, comfortable, and harm-free environment.

Accordingly, there is a need in the medical industry, and especially in the field of neo-natal care, for a mattress assembly and/or similar cushion or support structure that is capable of safely and adequately supporting the infant on a designated placement area of the mattress. If any such mattress assembly were developed, it would ideally also be structured to eliminate or significantly reduce the possibility of pain, discomfort, harm and/or damage to the infant's skin, head, or other body portions while the infant sleeps, moves or is moved, re-positioned, etc. during the care and treatment of the infant. In addition, if any such mattress assembly were developed, it would ideally also be structured for use independently of or in combination with other medical appliances such as, but not limited to, incubators commonly associated within premature or newborn infant care and treatment.

SUMMARY OF THE INVENTION

The present invention is intended to present a solution to these and other needs in the art, and as such, is directed to a mattress assembly or similar structure intended to support a premature and/or newborn infant especially, but not exclusively, in a medical and/or infant care facility. As such, the mattress assembly may be used independently or in combination with an incubator, infant warmer or other medical appliance of the type typically intended for infant care.

The mattress assembly of the present invention comprises a plurality of components cooperatively structured and disposed in at least partially retained relation to one another so as to collectively provide comfortable and substantially unrestricted support of the infant. The mattress assembly includes an exposed area for placement of the infant thereon and is structured to eliminate or significantly reduce frictional contact or engagement with the infant's skin, whether while sleeping or being cared for. Additionally, the mattress components are disposed in a substantially stacked array for cooperative interaction with one another in order to accommodate the normal position, movement, and/or manipulation of the infant while being cared for.

More specifically, the mattress assembly comprises a base formed of a relatively high strength, substantially rigid material and disposed as an underlying section in supporting relation to the remaining components of the mattress assembly. Further, the base includes sufficient rigidity and strength to facilitate the support of the mattress assembly on a variety of different supporting surfaces.

The mattress assembly also comprises a border, formed from a compressive foam material, disposed on an outer surface of the base and extending, preferably continuously, about the periphery thereof. A center portion of the border remains open for the positioning and at least partial containment of a cushioning assembly, to be described in greater detail hereinafter. As such, the border is disposed in substantially surrounding, retaining relation about the outer periphery of the cushioning assembly, wherein the cushioning assembly substantially defines the boundaries of the placement area on which the infant is normally positioned. As a result, the placement area is primarily located at the central area of the mattress assembly and is sufficiently dimensioned and configured to accommodate an infant, especially premature or newborn infants, of various sizes and weights. Accordingly, as set forth above, the entire mattress assembly may be dimensioned and configured to be placed within or otherwise be used in combination with an incubator commonly utilized in the care of newborn infants.

In addition, the cushioning assembly is formed from a plurality of compartments extending throughout the placement area, at least within the boundaries of the peripherally surrounding border. In at least one embodiment of the present invention, the interiors of the compartments forming the cushioning assembly are segregated from one another and at least partially filled with a viscous material such as, but not limited to, a silicone gel. Accordingly, the cushioning effects of the collectively disposed plurality of compartments, throughout and along the dimension and configuration of the placement area, provide adequate support and meaningful comfort to an infant disposed on the placement area.

The components of the mattress assembly also include a smoothing section, preferably in the form of a relatively thin sheet or layer of foam material, disposed in overlying relation to the collection of compartments defining the cushioning assembly. The material of the smoothing section is structured to demonstrate a "predetermined resistance to compression" in order to smooth over the undulating contours of the plurality of compartments beneath, but also to accommodate infants within a typical weight range. More specifically, the predetermined resistance to compression will provide sufficient resistance to the weight of the infant disposed on the placement area, uniformly distributing the pressure applied therefrom to prevent or significantly reduce the "sinking" of the infant into the more compressible plurality of compartments that define the cushioning assembly.

Further, in order to maintain the base, border, cushioning assembly and smoothing section in a predetermined stable and interactive disposition relative to one another, a cover assembly is disposed in retaining relation to these mattress components. The cover assembly is preferably formed of a flexible plastic or other appropriate material of sufficient strength which is dimensioned and configured to correspond to the assembled base, border, cushioning assembly and smoothing section. As a result, these mattress components are maintained in close, stable proximity to one another, thereby eliminating or significantly reducing the possibility of shifting out of an intended relative orientation.

It is well recognized that the skin of a severely premature infant is especially tender and fragile, and that it is extremely susceptible to abrasion upon frictional engagement with virtually any exterior surface or object. Accordingly, at least one embodiment of the mattress assembly of the present invention includes outer components or sections specifically designed to eliminate any friction or shear forces being exerted on the body of the infant from the exterior surfaces of the mattress assembly. More specifically, at least one embodiment of the mattress assembly includes a particulate component comprising an outer casing formed of a flexible, at least partially padded material having an open or hollow interior. As such, a plurality of very small beads is provided in sufficient quantity to at least partially fill the interior of the casing. The beads are loosely disposed within the interior of the casing in movable relation to one another. As a result, the beads will move and thereby accommodate the position and/or movement of the infant when disposed on the placement area.

The plurality of beads are preferably micro-sized silicone beads, or silicone microbeads, which are dimensioned, configured and structured to facilitate movement relative to one another, and thereby minimize frictional resistance to the infant placed in overlying relation to the particulate section on or within the placement area.

In order to eliminate or further reduce the possibility of frictional forces being applied to the skin of the infant, the outer surface of the mattress assembly, at least throughout the placement area, comprises an additional mattress component in the form a contact section. The contact section comprises a thin sheet or similarly structured layer formed of a shear resistant material. A variety of shear resistant materials may be utilized and are commonly characterized by a silky or extremely smooth surface, which significantly reduces any frictional engagement with the infant while disposed on the placement area.

Accordingly, the mattress assembly of the present invention can be used independently of or in combination with other medical appliances typically present and applied to the care, support and comfort of infants, especially prematurely born and/or newborn infants.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
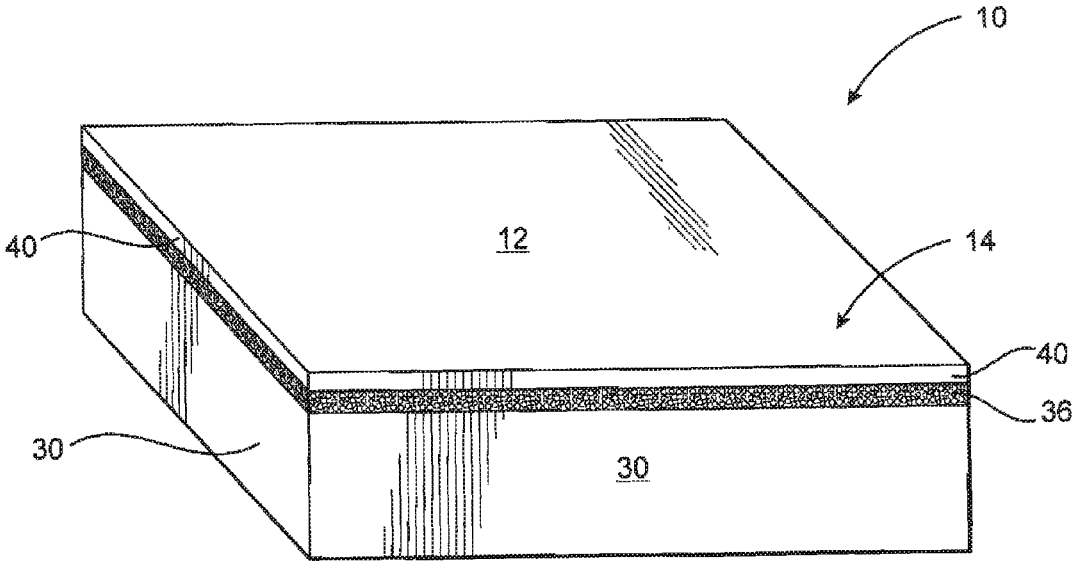
FIG. 1 is a perspective view of one embodiment of the mattress assembly of the present invention.
Figure 2:
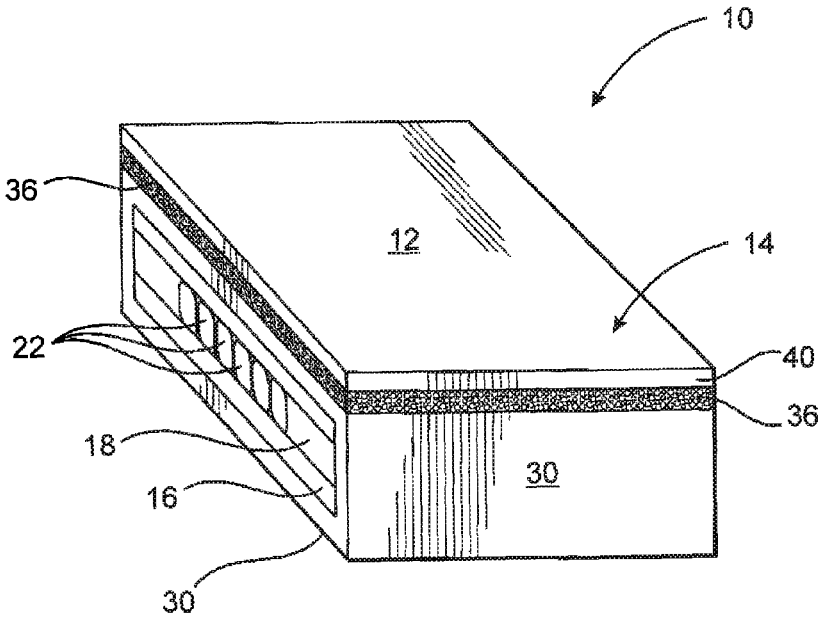
FIG. 2 is a perspective view of the invention shown in FIG. 1 but structurally modified to include a different dimension and/or configuration, and further shown in partial cut-away.

As represented in the accompanying drawings, the present invention is directed to a mattress assembly or like structure, as generally indicated by reference numeral 10. The mattress assembly 10 is intended to support an infant especially, but not exclusively, a premature and/or newborn infant while sleeping, being cared for and/or while receiving medical treatment in an infant care environment. The term "newborn" as used herein shall refer to and is intended to describe infants being less than one month old, but specifically, is meant to include premature infants, post mature infants and infants born full term. However, the structural and operational versatility of the various embodiments of the mattress assembly 10 of the present invention also facilitate its use with other infants. Therefore, as represented in the embodiments of FIGS. 1 and 2, the mattress assembly 10 may include a variety of different sizes and configurations so as to accommodate different sizes and weights of newborn and other infants. In addition, in at least certain embodiments, the mattress assembly 10 may be dimensioned and configured to be used in combination with an incubator assembly and/or be otherwise structured to facilitate its use with other medical equipment or appliances.

Accordingly, the mattress assembly 10 includes an exteriorly exposed placement area, generally indicated as 12 in FIGS. 1 and 2. The placement area is substantially centrally located and intended to support the infant when disposed thereon. However, the size and configuration of the placement area 12 is not intended to be strictly limited to the centralized portion of the outer surface 14 of the mattress assembly 10. To the contrary, it is recognized that the infant will typically move somewhat on his/her own and/or be moved, positioned or manipulated during care and treatment to more peripheral areas of the outer surface of the mattress assembly 10, while still receiving adequate support and protection. Accordingly, the placement area 12 is not intended to exclude the peripheral portions on the outer, exposed surface 14 of the mattress assembly 10.

Figure 3:
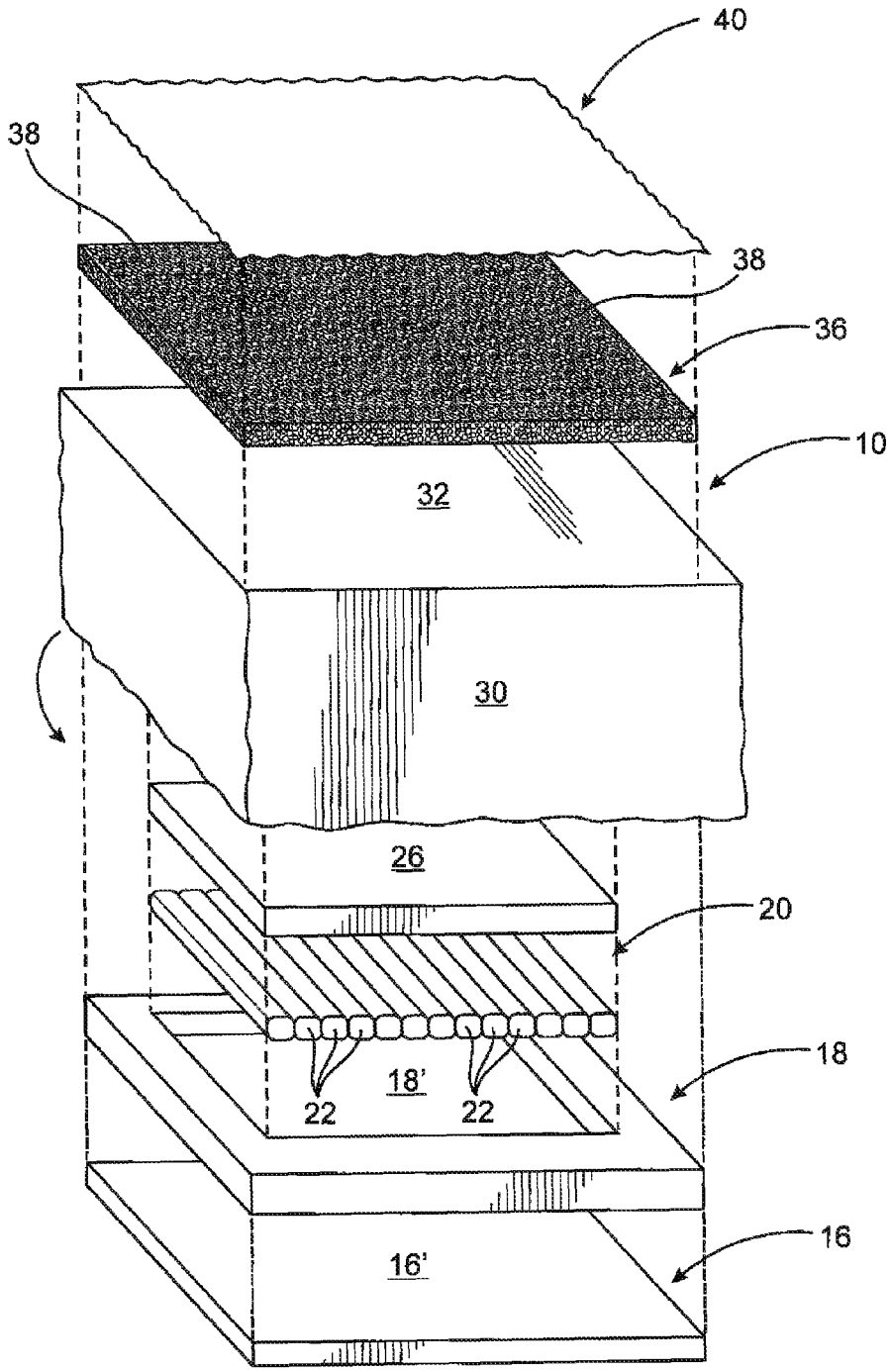
FIG. 3 is a perspective view in an exploded, non-assembled form representing the various components of the mattress assembly of the embodiments of FIGS. 1 and 2.

As represented in FIG. 3, one embodiment of the mattress assembly 10 comprises a plurality of interactive components represented in an unassembled orientation which are cooperatively structured and disposed, when assembled, to provide comfort and well-being to the infant disposed on the placement area 12. More specifically, the mattress assembly 10 comprises a base 16 formed of a substantially rigid plastic or other relatively high strength material which is disposed in supporting relation to all or at least some of the remaining components of the mattress assembly 10.

As such, the base 16 may facilitate the movement, placement and support of the mattress assembly 10 to and from a variety of locations, when assembled into the operative configuration of FIGS. 1 and 2. Further, the versatility of the mattress assembly 10 is enhanced by the structuring of the base 16 in a manner which facilitates the disposition and support of the mattress assembly 10 on different supporting surfaces and/or in combination with an incubator and/or other medical appliances, as generally set forth above. In at least one embodiment, a layer of foam is disposed in overlying relation to the base 16 to further enhance the comfort of an infant disposed on the mattress assembly 10.

Figure 4:
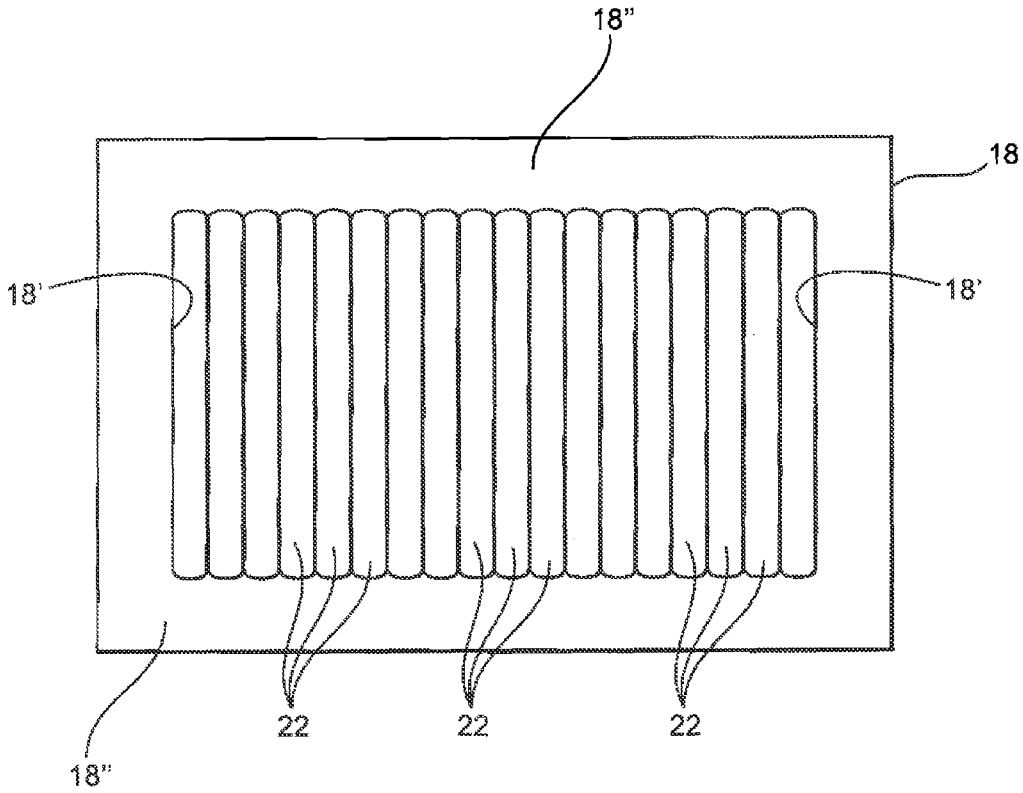
FIG. 4 is a top view of at least some of the partially assembled mattress components of the embodiments of FIG. 1 through 3.
Figure 5:
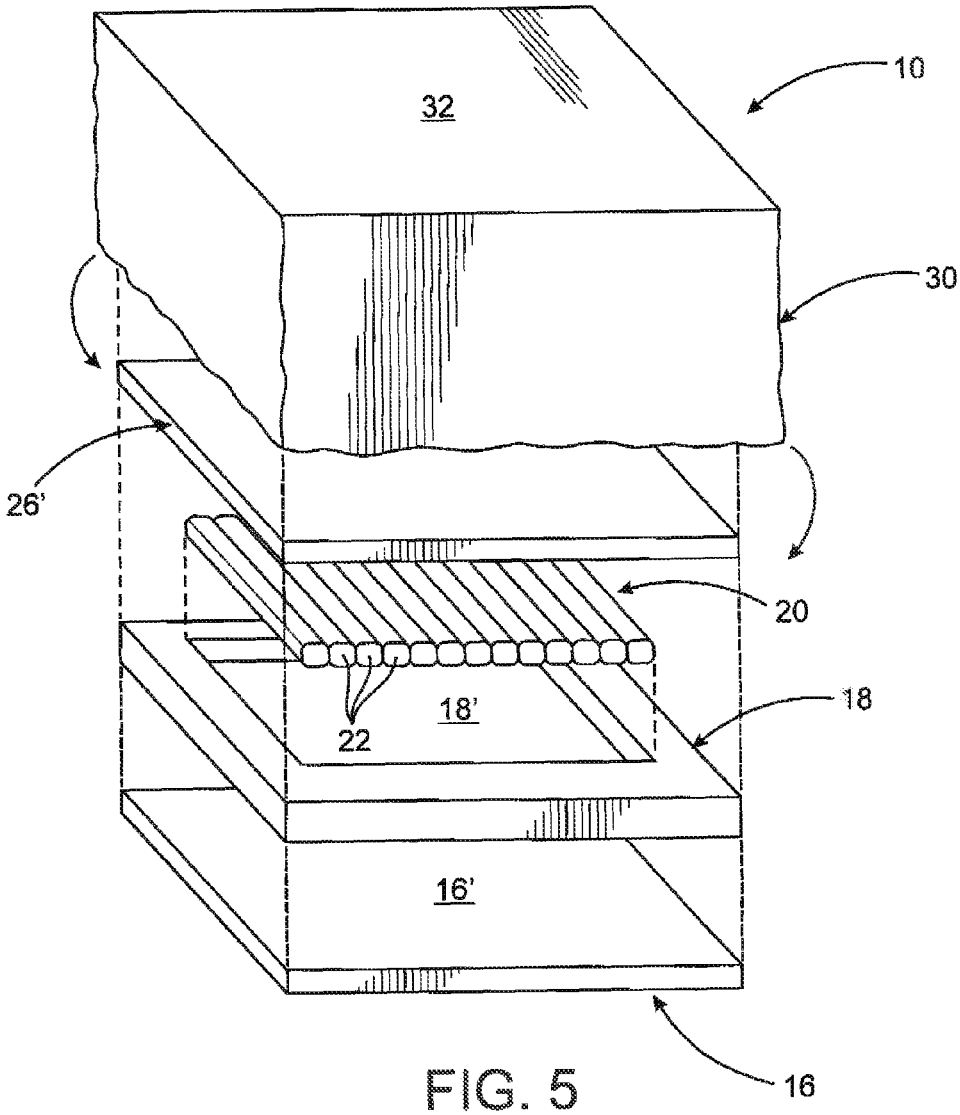
FIG. 5 is a perspective view in exploded form of an additional plurality of components from that represented in FIG. 4 and in conformance with the structure and operation of the embodiments of FIG. 1 through 3.

As also represented, the mattress assembly 10 includes a border structure generally indicated as 18, which is perhaps best shown in FIGS. 3, 4 and 5. The border 18 is preferably, but not necessarily, shaped into a substantially continuous, closed configuration surrounding an open interior area 18'. In its preferred operative position, the border 18 is secured to or disposed on a correspondingly disposed surface 16' of the base 16 in overlying relation thereto. As such, the border 18 extends continuously about the outer periphery of the base 16 in overlying relation to the corresponding surface 16'. In other embodiments, such as those in which a foam layer is disposed on top of the base 16, the border 18 is secured or otherwise disposed on the surface of this foam layer. The border is preferably formed from a compressible foam material, such as that commonly known as "blue-foam", which has viscoelastic physical characteristics. As such, the border 18 has sufficient compressive characteristics to aid in the comfortable support of an infant when located closer to the outer periphery of the exposed surface 14 of the mattress assembly 10, rather than being substantially centered on the placement area 12.

Yet another component of the mattress assembly 10 comprises a cushioning assembly generally indicated as 20, as perhaps is best shown in FIGS. 3 and 5. The structural integrity of the foam, or other compressible material from which the border 18 is formed, is such as to at least partially contain the cushioning assembly 20 within the open interior 18'. Further, the cushioning assembly 20 comprises a plurality of separate compartments 22, each having an elongated configuration. In one embodiment, the compartments 22 are collectively disposed in immediately adjacent or contiguous relation to one another within the open area 18'. In another embodiment, each of the separate compartments 22 is joined, attached, or otherwise connected to adjacent ones of the compartments 22. The dimension and orientation of the plurality of compartments 22 are such that the length of each compartment 22 preferably extends transversely to a length of the mattress assembly 10, as shown in FIGS. 2 through 4. Moreover, each of the plurality of compartments 22 has a sufficient length to extend beneath at least a majority of the intended placement area 12.

As such, the opposite ends of the plurality of compartments 22 terminate in aligned or confronting relation to the longitudinal sides as at 18" of the border 18. Therefore, the plurality of compartments 22 collectively extend in adjacent or contiguous relation to one another along substantially the entire length of the opening 18' and accordingly along at least the majority or the entirety of the length of the intended placement area 12. In addition, at least one embodiment of the present invention includes each, or at least a majority, of the plurality of compartments 22 comprising a multi-sided, cross-sectional configuration extending continuously along at least a majority of the length thereof.

Additional features of the cushioning assembly 20 specifically relating to the plurality of compartments 22 include an open or hollow interior in each being at least partially filled with a viscous material. The viscous material may be a silicone gel disposed on the interior of each of the plurality of compartments in sufficient quantity to allow for flexibility and a degree of compressibility of the cushioning assembly 20. In addition, the viscous nature of the silicone gel or other viscous material contained within the plurality of compartments 22 also facilitates the safe movement and/or the manipulation of the infant while disposed on the placement area 12.

The cushioning assembly 20 has a non-uniform or undulating surface contour as a result of the plurality of separate compartments 22 and the relative amounts of viscous material contained therein. Accordingly, the mattress assembly 10 also comprises a smoothing section, generally indicated as 26. The smoothing section 26 is a relatively thin sheet of foam or other flexible, at least partially compressible, material disposed in overlying relation to at least the cushioning assembly 20. Alternatively, as represented in the embodiments of FIG. 5, the smoothing section 26' may have a larger overall dimension than that of the cushioning assembly 20 and/or open area 18' of the border 18. Therefore, in such embodiment, the smoothing section 26' extends over the exterior, initially exposed surfaces of the border 18 as well as over the plurality of compartments 22 defining the cushioning assembly 20.

Additional structural and operative features of each of the smoothing sections 26 and 26' include their formation from a material which, while compressible, has a predetermined resistance to compression. Accordingly, the smoothing section 26 and/or 26' effectively "smoothes" over the undulations or irregularities in the contours of the surface of the cushioning assembly 20 disposed underneath and in contact with the smoothing section 26, 26'. Moreover, the material comprising the smoothing section 26, 26' creates an even distribution of pressure, thereby allowing an infant, disposed on the placement area 12, to more uniformly sink into the mattress assembly 10 without "excessive" sinking or sagging of the infant, into the open area 18, such as into the plurality of compartments 22. As a result, the infant will be firmly but comfortably supported on the placement area 12. However, the infant will experience sufficient compression of the mattress assembly 10, due to the infant's weight, to avoid any discomfort or harmful frictional contact or engagement with the outer surface 14.

Again, and with primary reference to FIGS. 3 and 5, an additional structural feature of the present invention includes the provision of a cover assembly 30. The cover assembly 30 is made from a flexible plastic material such as, but not limited to, polyethylene or polypropylene, and is dimensioned and configured to tightly contain the base 16, border 18, cushioning assembly 20 and smoothing section 26 in the intended, stacked, interactive orientation relative to one another, as at least partially represented in the cutaway portion of the embodiment of FIG. 2. More specifically, the flexible material cover 30 may have at least one access opening (not shown) or may otherwise be in sealed, retaining relation collectively about the base 16, border 18, cushioning assembly 20 and smoothing section 26 or 26', so as to form a modular or tightly retained assemblage on the interior of the cover assembly 30. It should be noted that the mattress components retained within the interior of the cover assembly 30 can also be otherwise attached to one another in order to further maintain the preferred, tightly stacked array. In such an additional embodiment, additional structural integrity may be provided to the mattress assembly 10 while maintaining a sufficient degree of flexibility and compressibility needed to assure support of the infant when disposed on the placement area 12.

As should be apparent and as well recognized in the medical community, the skin of a newborn and otherwise young infant is extremely fragile. As such, the tenderness of the infant's skin renders it susceptible to tearing or abrasion when frictionally engaging almost any exterior surface or object. Accordingly, the mattress assembly 10 further comprises a particulate section 36 disposed in overlying relation to the exterior surface 32 of the cover 30 once it is in retaining relation to the stacked array of components, as set forth above. The particulate section 36 comprises a casing 38 having a hollow interior at least partially filled with a plurality of loosely disposed beads. As such, the plurality of beads are movable relative to one another and to the infant disposed on the placement area 12. The loose collection of beads will accommodate any reasonable force exerted thereon by the weight and/or movement of the infant, while the infant is sleeping, resting or being manipulated during its care or treatment. The beads may preferably comprise a plurality of micro-sized silicone beads, sufficient in quantity to further add to the comfort of the infant and aid in the reduction of any frictional engagement between the outer surface 14 and the skin of the infant.

In order to further eliminate or significantly reduce the possibility of any frictional force or frictional engagement between the mattress assembly 10 and the skin of the infant disposed on the placement area 12, the mattress assembly 10 further comprises a contact section generally indicated as 40. The contact section 40 may comprise a single, thin sheet or like structure dimensioned and configured to extend over all of the placement area 12 and over all or at least the majority of the exterior surface 14, as represented in FIGS. 1 and 2. Further, the contact section 40 is preferably formed of a shear resistant material so as to eliminate or significantly reduce any frictional contact or frictional engagement with the infant when disposed on the placement area 12. By way of example only, the material from which the contact section 40 is formed may have a "silky" feel not unlike certain materials, such as nylon, from which parachutes are formed and/or may comprise a silicone-impregnated material. Therefore, a lack of frictional engagement between confronting portions of the infant and the outer surface 14 will eliminate or significantly reduce the possibility of any damage to the skin of the infant.

It is further emphasized that the materials from which all the components of the mattress assembly 10 are formed should also be water resistant, non-flammable, hypo-allergenic, UV-resistant, and otherwise treated to avoid any undesirable reactions with infants.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A mattress assembly structured for support of a newborn infant and for use in an infant care appliance, said mattress assembly comprising:

a support section disposed to at least partially support a remaining portion of said mattress assembly on a support surface, said support section comprising at least one portion comprising a viscous material and at least one other portion comprising a rigid material, a particulate section disposed in overlying relation to at least part of said support section, said particulate section comprising a casing formed of a flexible material and including a plurality of silicone beads loosely disposed therein in moveable relation to one another and structured and dimensioned to reduce frictional engagement between said mattress assembly and the sensitive skin of an infant, a placement area dimensioned and configured to correspond substantially to the size of an infant and defined along at least a portion of said particulate section, a contact section formed of a sufficiently shear resistant material disposed in overlying relation to at least said particulate section to minimize frictional engagement with and substantially eliminate damage to the sensitive skin of an infant placed thereon, and wherein each of said support section, said particulate section, said placement area, and said contact section comprise outer peripheries dimensioned to fit within an infant care appliance.

2. The mattress assembly as recited in claim 1 wherein said plurality of silicone beads are silicone microbeads.

3. The mattress assembly as recited in claim 1 wherein said viscous material is a silicone gel.

4. The mattress assembly as recited in claim 1 wherein said support section further comprises a base formed substantially of plastic.

5. The mattress assembly as recited in claim 4 wherein said support section further comprises a border disposed in overlying relation to said base and extending substantially along an outer periphery thereof.

6. The mattress assembly as recited in claim 5 wherein said support section further comprises a cushioning assembly disposed within said border and including a plurality of compartments, each of said compartments at least partially filled with a viscous material.

7. A mattress assembly structured for support of a newborn or premature infant and further structured for use in an infant care appliance, said mattress assembly comprising:

a base disposed in underlying, supporting relation to a remainder of said mattress assembly, a border having an open interior portion and disposed in overlying relation to said base, a cushioning assembly disposed within said open interior portion and in overlying relation to said base and dimensioned and configured to accommodate an infant and at least partially comprising a viscous material, a smoothing section disposed in overlying relation to at least said cushioning assembly, said smoothing section formed of a flexible material having a predetermined resistance to compression so as to distribute pressure uniformly and thereby reduce sinking of the infant into said cushioning assembly, a particulate section disposed in overlying relation to said smoothing section and comprising a flexible case including a plurality of microbeads loosely disposed therein in moveable relation to one another, said plurality of microbeads dimensioned and structured to reduce frictional engagement between said mattress assembly and the sensitive skin of an infant, a contact section formed of a sufficiently shear resistant material to minimize frictional engagement with the sensitive skin of an infant placed thereon and disposed in overlying relation to at least said particulate section, said shear resistant material and said plurality of microbeads cooperatively disposed and structured to substantially eliminate damage to the sensitive skin of an infant, and wherein each of said base, said border, said cushioning assembly, said smoothing section, said particulate section, and said contact section comprise outer peripheries dimensioned to fit within an infant care appliance.

8. The mattress assembly as recited in claim 7 wherein said cushioning assembly is disposed entirely within said open interior portion.

9. The mattress assembly as recited in claim 7 wherein said cushioning assembly comprises a plurality of separate compartments.

10. The mattress assembly as recited in claim 9 wherein each of said plurality of separate compartments is at least partially filled with viscous material.

11. The mattress assembly as recited in claim 10 wherein said viscous material comprises a silicone gel.

12. The mattress assembly as recited in claim 9 wherein said plurality of compartments are disposed in adjacent relation to one another.

13. The mattress assembly as recited in claim 12 wherein each of said plurality of compartments is connected to an adjacent one of said plurality of compartments.

14. The mattress assembly as recited in claim 7 wherein said plurality of compartments extend between and terminate at opposite longitudinal sides of said border.

15. A mattress assembly structured for use in an infant care appliance to prevent skin damage in newborn and premature infants, said mattress assembly comprising:

a base formed of a substantially rigid solid material and disposed in supporting relation to the remainder of said mattress assembly, a border disposed in overlying relation to said base and extending substantially along an outer periphery thereof, defining an open interior therein, a cushioning assembly disposed within said open interior of said border and dimensioned and configured to accommodate an infant and including a plurality of separate compartments, each of said compartments at least partially filled with a viscous material, a smoothing section comprising a flexible material and disposed in overlaying relation to at least said cushioning assembly to evenly disperse pressure of an infant, a particulate section comprising a plurality of silicone microbeads structured and disposed so as to reduce damage to the skin of the infant, a contact section comprising a sufficiently shear resistant material to minimize frictional engagement with the sensitive skin of an infant placed thereon and disposed in confronting relation to an infant disposed on said mattress assembly, and wherein each of said base, said border, said cushioning assembly, said smoothing section, said particulate section, and said contact section comprise outer peripheries dimensioned to fit within an infant care appliance.

16. The mattress assembly as recited in claim 15 wherein said viscous material comprises silicone gel.

17. The mattress assembly as recited in claim 15 wherein said base comprises a plastic material.

18. The mattress assembly as recited in claim 15 wherein said border comprises a compressible foam material.

19. The mattress assembly as recited in claim 15 further comprising an exteriorly exposed placement area disposed above and in substantially aligned relation to at least said cushioning assembly and dimensioned to accommodate an infant.

20. The mattress assembly as recited in claim 19 wherein said plurality of compartments include an elongate configuration collectively and are transversely oriented along a length of said placement area.

21. The mattress assembly as recited in claim 19 wherein said smoothing section is disposed in aligned relation to said placement area.

22. The mattress assembly as recited in claim 19 wherein said contact section is disposed throughout said placement section.

23. The mattress assembly as recited in claim 15 further comprising a cover assembly disposed in enclosing retaining relation to at least said base, said border, and said cushioning assembly and formed of a flexible at least partially cushioning material.

* * * * *